US010627099B2

(12) United States Patent
Van Bommel et al.

(10) Patent No.: US 10,627,099 B2
(45) Date of Patent: Apr. 21, 2020

(54) LIGHTING ASSEMBLY FOR EMITTING HIGH INTENSITY LIGHT, A LIGHT SOURCE, A LAMP AND A LUMINAIRE

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/305,998

(22) PCT Filed: Jun. 20, 2017

(86) PCT No.: PCT/EP2017/064984
§ 371 (c)(1),
(2) Date: Nov. 30, 2018

(87) PCT Pub. No.: WO2018/001781
PCT Pub. Date: Jan. 4, 2018

(65) Prior Publication Data

US 2019/0212004 A1 Jul. 11, 2019

(30) Foreign Application Priority Data

Jun. 28, 2016 (EP) ..... 16176566

(51) Int. Cl.
*F21V 29/76* (2015.01)
*F21V 29/15* (2015.01)
(Continued)

(52) U.S. Cl.
CPC ..... *F21V 29/76* (2015.01); *F21S 4/24* (2016.01); *F21V 7/00* (2013.01); *F21V 29/15* (2015.01);
(Continued)

(58) Field of Classification Search
CPC .... F21S 4/10; F21S 4/24; F21V 29/15; F21V 29/56; F21V 29/76; F21V 7/00;
(Continued)

(56) References Cited

U.S. PATENT DOCUMENTS 8,071,882 B2 * 12/2011 Okajima ..... H05K 1/028 174/250
9,464,800 B2 * 10/2016 Kim ..... F21V 19/003
(Continued)

FOREIGN PATENT DOCUMENTS

DE 102006033894 A1 6/2007
EP 2650589 A1 10/2013
(Continued)

*Primary Examiner* — Peggy A Neils
(74) *Attorney, Agent, or Firm* — Daniel J. Piotrowski

(57) ABSTRACT

A lighting assembly (100), a light source, a lamp and a luminaire are provided. The lighting assembly comprises a heat transferring element (102) and an elongated structure (120) comprising light emitting elements (122, 122') and power connections. The heat transferring element comprises at a first side (104) a heat sink interface or a heat sink element. At the second opposite side (106) one or more upstanding walls (108, 108') are provided extending away from the second side. The upstanding walls are heat conductive and thermally coupled to the first side. The elongated structure is arranged on a wall surface of at least one of the upstanding walls. The wall surface is adjacent to the second side. A surface of the elongated structure through which no light is emitted is thermally coupled to the wall surface. A pattern formed by the elongated structure is a meandering or spiral pattern.

13 Claims, 9 Drawing Sheets

(51) Int. Cl.

| | |
|---|---|
| ***F21S 4/24*** | (2016.01) |
| ***F21V 7/00*** | (2006.01) |
| ***F21Y 115/10*** | (2016.01) |
| ***F21Y 103/30*** | (2016.01) |
| ***F21Y 105/18*** | (2016.01) |
| ***F21S 4/10*** | (2016.01) |
| ***F21Y 107/70*** | (2016.01) |
| ***F21Y 107/50*** | (2016.01) |
| ***F21Y 103/10*** | (2016.01) |
| ***F21V 29/56*** | (2015.01) |

(52) U.S. Cl.
CPC ..... *F21S 4/10* (2016.01); *F21V 29/56* (2015.01); *F21Y 2103/10* (2016.08); *F21Y 2103/30* (2016.08); *F21Y 2105/18* (2016.08); *F21Y 2107/50* (2016.08); *F21Y 2107/70* (2016.08); *F21Y 2115/10* (2016.08)

(58) Field of Classification Search
CPC ..... F21Y 2105/18; F21Y 2107/50; F21Y 2107/70; F21Y 2115/10
See application file for complete search history.

(56) References Cited

U.S. PATENT DOCUMENTS

| | | | | |
|---|---|---|---|---|
| 9,528,689 | B2 * | 12/2016 | Veres | H01L 33/54 |
| 9,841,169 | B2 * | 12/2017 | Sweegers | F21V 29/58 |
| 10,018,777 | B2 * | 7/2018 | Na | G02B 6/0091 |
| 2003/0002282 | A1 | 1/2003 | Swaris et al. | |
| 2006/0138951 | A1 | 6/2006 | Tain et al. | |
| 2008/0253116 | A1 | 10/2008 | Liao | |
| 2010/0284169 | A1 | 11/2010 | Bertram et al. | |
| 2011/0267812 | A1 * | 11/2011 | Van de Ven | F21K 9/00 362/235 |
| 2012/0201024 | A1 | 8/2012 | Van den Ven et al. | |
| 2015/0198320 | A1 | 7/2015 | Kim et al. | |
| 2015/0233534 | A1 | 8/2015 | Kaiser et al. | |
| 2016/0003459 | A1 | 1/2016 | Sweegers et al. | |

FOREIGN PATENT DOCUMENTS

| | | | |
|---|---|---|---|
| JP | 2006258888 | A | 9/2006 |
| JP | 2013134857 | A | 7/2013 |
| WO | 2015131139 | A1 | 9/2015 |

* cited by examiner

LIGHTING ASSEMBLY FOR EMITTING HIGH INTENSITY LIGHT, A LIGHT SOURCE, A LAMP AND A LUMINAIRE

CROSS-REFERENCE TO PRIOR APPLICATIONS

This application is the U.S. National Phase application under 35 U.S.C. § 371 of International Application No. PCT/EP2017/064984, filed on Jun. 20, 2017 which claims the benefit of European Patent Application No. 16176566.4, filed on Jun. 28, 2016. These applications are hereby incorporated by reference herein.

FIELD OF THE INVENTION

The invention relates to a lighting assembly for emitting high intensity light.

The invention further relates to a light source, a lamp and a luminaire.

BACKGROUND OF THE INVENTION

Today Light Emitting Diodes are often used in lighting assemblies or lamps. One Light Emitting Diode (LED) often lacks enough light output to form a lamp that replaces well-known incandescent lamps, halogen lamps or gas discharge lamps even if high lumen Light Emitting Diodes are used. Therefore, in several lighting assemblies, several Light Emitting Diodes are combined into one assembly to increase the total light intensity that may be emitted by the assembly. A known way of combining several Light Emitting Diodes is to assemble them in an array-like configuration on a printed circuit board. The printed circuit board is an example of a substrate on which the Light Emitting Diodes can be provided. The printed circuit board may be build up by combining several layers of metal and electrical isolators such that heat can be transported away from the Light Emitting Diodes—each Light Emitting Diode must be cooled because it generates a relatively large amount of heat in a relatively small volume. A disadvantage of arranging the Light Emitting Diodes in an array-like configuration on a substrate is that each Light Emitting Diode has, seen in two perpendicular directions along the substrate, 4 to 8 neighbor Light Emitting Diodes. The heat generated by each one of the Light Emitting Diodes is spread into a direction along the substrate and, thus, heat generated by a Light Emitting Diode is distributed towards its neighbor Light Emitting Diodes. Thus, the Light Emitting Diodes heat each other up. If Light Emitting Diodes become too warm, their efficiency decreases and their lifetime is reduced significantly.

The above discussed example of a lighting assembly has also another disadvantage. For example, when quite a large number of Light Emitting Diodes must be integrated into a single assembly, the area of the substrate becomes relative large and thereby the assembly is not compact anymore.

SUMMARY OF THE INVENTION

It is an object of the invention to provide a compact lighting assembly for emitting high intensity light that has a better thermal management.

For this purpose, according to an aspect of the invention, a lighting assembly is provided. For this purpose, according to further aspects of the invention, a light source, a lamp and a luminaire are provided that may comprise the lighting assembly.

The lighting assembly comprises an elongated structure and a heat transferring element. The elongated structure comprises a flexible substrate. On the flexible substrate light emitting elements and power connections for providing power to the light emitting elements are provided. The light emitting elements are arranged in a longitudinal direction of the elongated structure. The heat transferring element comprises a base plate that comprises a first side and an opposite second side. The heat transferring element comprises at the first side a heat sink interface or a heat sink element. The heat sink interface is for providing an interface to a heat sink. The second side of the heat transferring element is opposite to the first side. At the second side one or more upstanding walls are provided that extend away from the second side. The one or more upstanding walls comprise a heat conductive material and are thermally coupled to the first side. The elongated structure is arranged on a wall surface of at least one of the one or more upstanding walls. The wall surface is one of the surfaces of the one or more upstanding walls that is adjacent to the second side. A surface of the elongated structure through which no light is emitted is thermally coupled to the wall surface. A pattern formed by the elongated structure is a meandering or spiral pattern. The pattern is defined in a cross-sectional plane parallel to the second side. The meandering pattern comprises at least three turns and the spiral pattern comprises a plurality of windings.

The features of the lighting assembly have the effect that in a relatively compact lighting assembly a relatively long elongated structure with light emitting elements can be arranged while at the same moment in time the light emitting elements are well cooled. The meandering or spiral pattern that is followed by the elongated structure allows the arrangement of a relatively large amount of light emitting elements in a relatively small volume. The use of the upstanding walls allows the effective transfer of heat from the light emitting elements towards the first side of the heat transferring element. Because the light emitting elements are arranged in the longitudinal direction of the elongated structure, each light emitting element has a relatively small amount of neighbors, for example, 2 neighbors (seen in the longitudinal direction) and, consequently, the light emitting elements are not heated up by too many other light emitting elements. At the same time, the upstanding side walls transport the heat towards the first side where the heat is provided via a heat sink to the ambient. Thus, the light emitting elements are well cooled.

Optionally, spaces between at least a portion of the one or more upstanding walls one or more form channels. Optionally, at least 75% of the light emitting elements emit a portion of their light towards a second surface of an opposite wall of the channel. The opposite wall of the channel is a portion of the one or more upstanding walls. The opposite wall having two surfaces adjacent to second side of which one is the wall surface and another one is the second surface. Optionally, reflective material is provided or light outcoupling elements are provided in the channels at at least a portion of locations of the one or more channels that are illuminated by the light emitting elements. In other words, the portion of the one or more upstanding walls partially enclose one or more channels. Also the term groove may be read instead of channel, however, the term groove does not necessarily means that with a mechanical tool a groove is formed in another material. This optional embodiment provides a better light output and, thus, a higher efficiency of the lighting assembly. In particular, if diffusely reflective elements are used, or when the surfaces of the channels are reflective or diffusely reflective, a more homogeneous light output may be obtained from the lighting assembly.

Optionally, spaces between at least a portion the one or more upstanding walls form one or more channels that are covered at an opposite side of the second side with a light transmitting material for sealing the opposite side of the one or more channels, and the one or more channels are provided with a cooling material inlet and a cooling material outlet for allowing a cooling material to flow through the one or more channels for cooling the light emitting elements of the elongated structure. In other words, the portion of the one or more upstanding walls together with the light transmitting materials enclose one or more channels. This optional embodiment provides a better cooling of the light emitting elements, and, thus a better thermal management. The upstanding walls have in this embodiment the additional function to form surfaces of the channel such that a cooling material can circulate through the lighting assembly.

Optionally, a wall pattern formed by a portion of the one or more upstanding walls is a meandering or spiral pattern, the wall pattern is defined in a cross-sectional plane parallel to the second side. Not only the elongated structure may follow the meandering or spiral pattern, the walls may also have this pattern thereby defining the pattern of the elongated structure. Thereby there is a relatively high amount of upstanding wall surface such that the elongated structure can be supported relatively well.

Optionally, a first portion of the one or more upstanding walls is thermally isolated from a second portion of the one or more upstanding walls while the one or more upstanding walls of the first portion and of the second portion are thermally coupled to the first side. This optional provides the benefit that possible thermal paths between light emitting elements are limited and, thus, that the risk that light emitting elements heat each other up is reduced.

Optionally, the elongated structure is a LED strip made of a flexible substrate on which solid state light emitters are provided and on which electrical conductive tracks are provided that form the power connections. LED strips are advantageous elongated structures because they are relatively cheap and are flexible enough to be arranged in a spiral or meandering pattern in the lighting assembly. Another alternative is that the elongated structure comprises a sequence of solid state light emitter that are coupled to each other by means of wires that form the power connections.

Further preferred embodiments of the lighting assembly according to the invention are given in the appended claims, disclosure of which is incorporated herein by reference.

BRIEF DESCRIPTION OF THE DRAWINGS

These and other aspects of the invention will be apparent from and elucidated further with reference to the embodiments described by way of example in the following description and with reference to the accompanying drawings, in which FIG. 1 schematically shows an embodiment of a lighting assembly, FIG. 2 schematically shows another embodiment of a lighting assembly, FIG. 3 schematically shows several cross-sectional views of alternative embodiments of one of the lighting assemblies of FIG. 1 or 2, FIG. 4 schematically shows a further embodiment of a lighting assembly, FIG. 5 schematically shows yet another embodiment of a lighting assembly, FIG. 6 schematically shows several cross-sectional views of previously discussed lighting assemblies in which optical elements are introduced to improve light output from the lighting assembly, FIG. 7 schematically shows several cross-sectional views of alternative embodiments of previously discussed lighting assemblies, FIG. 8 schematically presents embodiments of meandering or spiral patterns that can be followed by the elongated structure and/or the upstanding wall(s), FIG. 9 schematically presents embodiments of an elongated structure, and FIG. 10 schematically presents embodiments of a lamp and of a luminaire.

The figures are purely diagrammatic and not drawn to scale. In the Figures, elements which correspond to elements already described may have the same reference numerals.

DETAILED DESCRIPTION OF EMBODIMENTS

Figure 1:
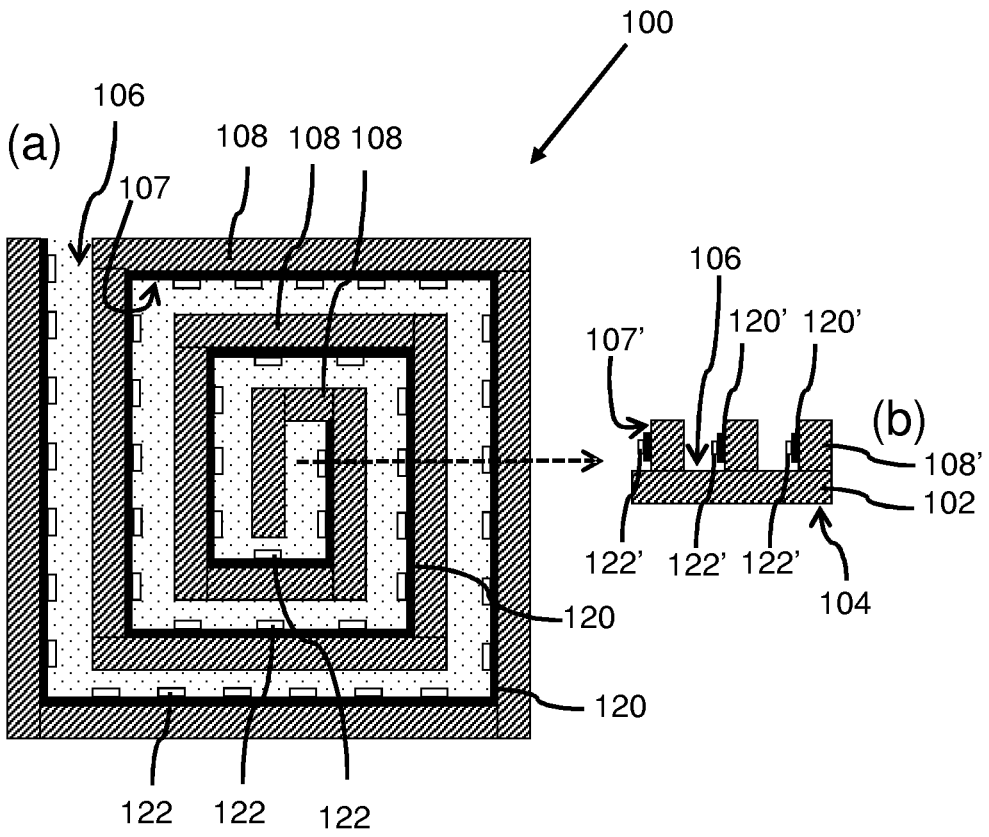

FIG. 1 schematically shows an embodiment of a lighting assembly 100. The lighting assembly is for emitting high intensity light, for example, more than 500 lumen, or optionally more than 800 lumen, or optionally more than 1200 lumen.

At the left side of FIG. 1 a top view is presented of the lighting assembly 100. At the right side of FIG. 1 a cross-sectional view of a portion the lighting assembly 100 along a plane defined by the dashed arrow in the top view. The lighting assembly 100 comprises a heat transferring element 102 that comprises upstanding walls 108, 108'. The heat transferring element 102 has a first side 104 and a second side 106 opposite the first side 104. The first side 104 is, in the example of FIG. 1, a heat sink interface to which a heat sink can be thermally coupled. The upstanding walls 108, 108' extend away from the second side 106 of the heat transferring element 102. The upstanding side walls have wall surfaces 107, 107' that are adjacent to the second side 106—this means that the wall surfaces 107, 107' are at one side in direct contact with the second side 106; it also means that there is an angle between the wall surfaces 107, 107' and the second side 106 and this angle is, optionally, in between 85 and 95 degrees, optionally in between 88 and 92 degrees and is optionally substantially equal to 90 degrees. Please note that the when the term "wall surfaces 107, 107'" is used in the context of this document, only the wall surfaces are meant that are adjacent to the second side 106 and to which an elongated structure is arranged (as will be discussed hereinafter). The upstanding walls 108, 108' are made of a heat conductive material and they are thermally coupled to the first side 104. In the example of FIG. 1, the whole heat transferring element 102 is made of a heat conductive material and, as such, the upstanding walls 108, 108' are thermally coupled to the first side 104. The heat transferring element 102 may be a homogeneous structure, or the walls 108, 108' may be manufactured and thermally coupled separately to a base plate of the heat transferring element 102 (which is the plate that has the first side 204 and the second side 106). It is to be noted that, in another embodiment, the first side 104 may also be provided with, for example, cooling fins such that the first side 104 is a heat sink.

The lighting assembly 100 also comprises an elongated structure 120, 120' that comprises light emitting elements 122, 122'. The elongated structure 120, 120' comprises, for example, 5 or more light emitting elements 122, 122', or optionally more than 10 light emitting element 122, 122', or optionally more than 20 light emitting elements 122, 122. The elongated structure 120, 120' also comprises power connections for providing power to the light emitting element 122, 122'. In the example of FIG. 1, the elongated structure 120, 120' is, for example, a Light Emitting Diodes strip (LED strip) that has an elongated flexible substrate (as drawn in FIG. 1, this is, for example, element 120, 120') on which electrically conductive tracks are provided that conduct power towards LEDs (as drawn in FIG. 1, these are, for example, the light emitting elements 122, 122'). The LEDs are provided as a sort of sequence on the elongated structure, which means that each LED has a maximum of two direct neighboring LEDs. The fact that the LEDs are provided as a sort of sequence on the elongated structure does not directly mean that they are electrically coupled in an electrical series or an electrical parallel arrangement—both arrangements may be possible and also combinations of electrical series and electrical parallel arrangements are possible.

In general, the light emitting element 122, 122' may be solid state light emitters. Examples of solid state light emitters are Light Emitting Diodes (LEDs), Organic Light Emitting diode(s) OLEDs, or, for example, laser diodes. The light emitting element 122, 122' may also be a solid state light emitter package that comprises the solid state light emitter. The light emitting element 122, 122' may also comprise a solid state light emitter that is provided with a luminescent material that at least partly converts light emitted by the solid state light emitter towards light of another color.

As shown in FIG. 1, the elongated structure 120, 120' is arranged on a plurality of the wall surfaces 107, 107' of the plurality of upstanding walls 108, 108'. A surface of the elongated structure 120, 120' through which the light emitting elements 122, 122' do not emit light are brought in contact in a thermally conductive manner with the wall surfaces 107, 107'. The elongated structure 120, 120' is arranged on the wall surfaces 107, 107' such that heat generated in the light emitting element 122, 122' is conducted towards the upstanding walls 108, 108'. Thus, the heat generated by the light emitting element 122, 122' is mainly transmitted towards the first side 104 because that is a location that is cooler because of the coupling to or the presence of a heat sink. In general, heat is conducted from a relatively warm location to a relatively cold location, nevertheless, it may be that some heat generated by a specific light emitting element 122, 122' is transferred to a neighboring light emitting element 122, 122'. Compared to known solutions, this is a significant reduction of heat transfer towards neighboring light emitting element 122, 122'. Thus, the heat transferring element in combination with the elongated structure provides a good heat management that prevents overheating of the light emitting elements 122, 122'. It is to be noted that, compared to the array-like arrangement of light emitting elements on a flat substrate (as discussed in the back ground of the art section) one may interpret the cooling configuration of FIG. 1 also as a configuration in which the average length of all heat conductive paths between the light emitting elements is increased, because of the upstanding walls 108 and because of the elongated arrangement of the light emitting elements. Thus, on average, each light emitting element will receive less heat from neighboring light emitting elements.

As seen in FIG. 1, the elongated structure 120, 120' follows a spiral pattern. The spiral pattern has about 3 windings. FIG. 1 is a top view, thus, the spiral pattern is seen in a plane that is parallel to the second side 106. It is to be noted that a spiral pattern must be interpreted broadly: it does not necessarily mean that the "lines" of the spiral are curved lines, the curved lines may also be approximated with a plurality of straight lines. In FIG. 1, one "rotation" around the center of the spiral is approximated with 4 straight lines. It is to be noted that one may also approximate the "rotations" of the spiral with three lines which would result in a triangular shaped spiral. The more straight lines are used, the better the curved shape of the spiral is approximated. Please note that in the example of FIG. 1, the upstanding walls 108, 108' also form a spiral pattern. It is to be noted that the upstanding walls do not necessarily form this pattern because, as will be discussed later, one may also provide separate upstanding walls that are individually coupled to the elongated structure 120, 120' only at a location where the elongated structure 120, 120' has a light emitting element 122, 122'.

In line with the discussed above example, if the elongated structure 120, 120' is a LED strip that is based on an elongated flexible substrate, one can easily provide the LED strip to the wall surfaces 107, 107' because one is able to bend the flexible substrate in the corners between adjacent wall surfaces 107, 107'.

Because of the use of the elongated structure 120, 120' and the use of upstanding walls 108, 108', the spiral pattern can be obtained. As can be seen in FIG. 1 a relatively large number of light emitting elements 122, 122' can be integrated in the light emitting element 100 in which the elongated structure 120, 120' is bent into a spiral pattern. Thereby the lumen output of the lighting assembly 100 is relatively high while the lighting assembly 100 is still compact. Compared to lighting assemblies wherein the light emitting elements are provided in an array on the second surface, much more light emitting elements 122, 122' can be provided in the lighting assembly 100 of FIG. 1. In line with the embodiment of FIG. 1, the elongated structure 120, 120' may have a flexible substrate on which the light emitting elements 122, 122' are provided.

Figure 2:
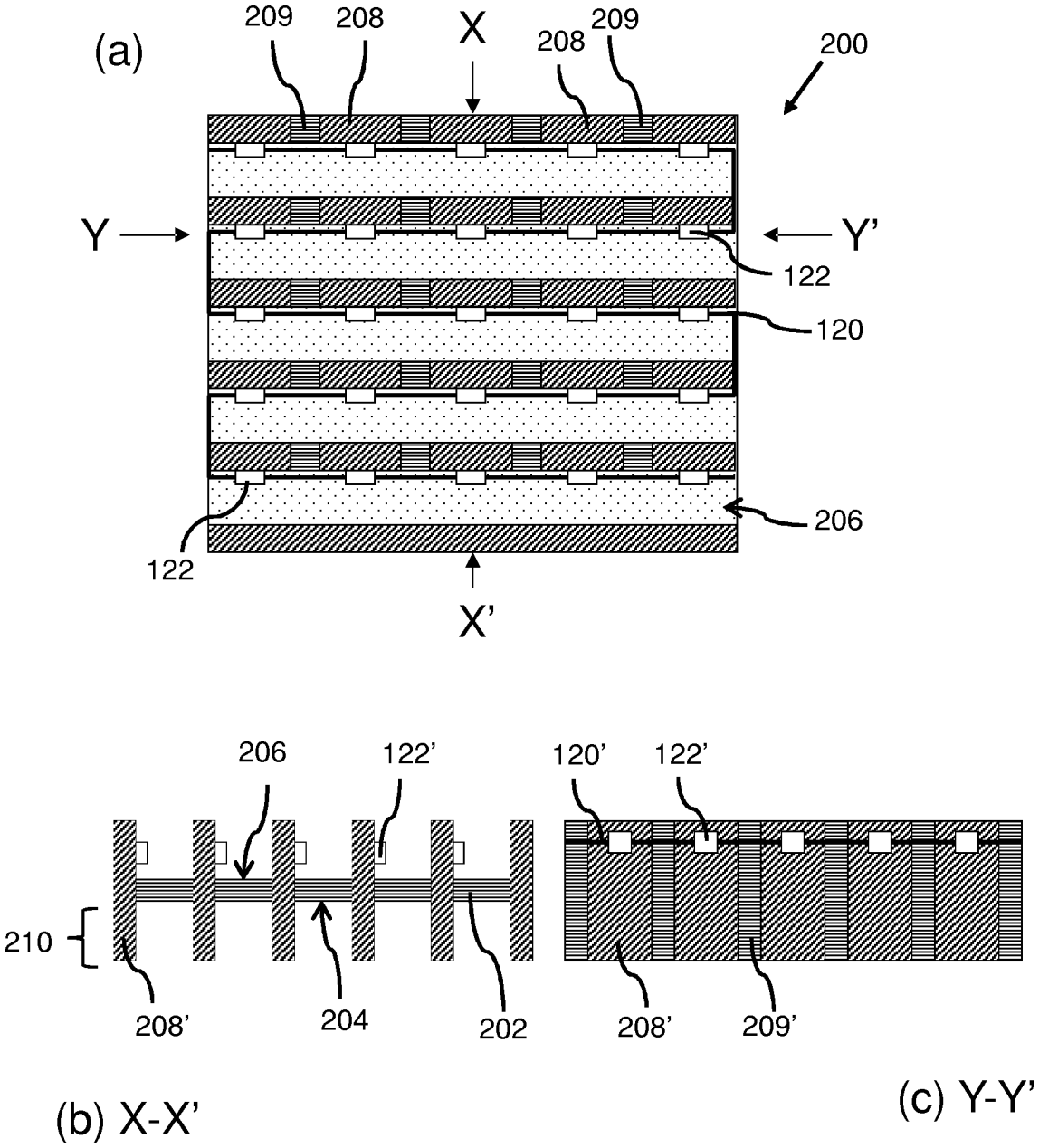

FIG. 2 schematically shows another embodiment of a lighting assembly 200. Lighting assembly 200 is similar to lighting assembly 100 and has similar effects and advantages. Differences will be discussed hereinafter. At the top of FIG. 2, at (a), a top view is presented. In the top view two virtual lines are indicated: one between the arrows indicated with X and X' and one between the arrows indicated with Y and Y'. At the bottom left end of FIG. 2, at (b), a cross sectional view of the lighting assembly 200 is presented along a plane that is defined by line X-X'. At the bottom right end of FIG. 2, at (c), a cross sectional view of the lighting assembly 200 is presented along a plane that is defined by line Y-Y'.

In the example of FIG. 2, the elongated structure 120, 120' is arranged in a meandering pattern when seen in this top view. The meandering pattern has about four turns: as presented in FIG. 2 at (a), two at the left side of the lighting assembly 200 and two at the right side of the lighting assembly 200. Thereby, in line with the lighting assembly of FIG. 1, a relatively large number of light emitting elements 120 can be provided in the lighting assembly 200 while the lighting assembly 200 remains relatively compact. Thus, the lighting assembly 200 may have a relatively high lumen output. Also in this context it must be noted that meandering is to be interpreted broadly: it is not necessary that the elongated structure 120, 120' meanders in nice curves as a river does—it may also meander in a pattern that is formed by straight lines; in other words, the nice curves of a meandering river may be approximated with a relatively small number of straight lines.

In the example of FIG. 2, basis of the heat transmitting element is a heat isolating plate 202. This heat isolating plate 202 has a first side 204 at which cooling fins extend that form a heat sink 210. At the second side 206 of the heat isolating plate 202 (which is a side opposite to the first side 204) there are a plurality of upstanding walls 208, 208' that extend through the heat isolating plate 202 and protrude out of the heat isolating plate 202 at the first side 204 to form the cooling fins. Thereby the plurality of upstanding walls 208 are thermally coupled to the first side 204 of the heat isolating plate 202. In between the plurality of upstanding walls 208 upstanding heat isolating structures 209 are provided to prevent heat transfer from one upstanding side wall 208 towards its neighboring upstanding side wall 208. Thereby it is prevented that light emitting elements 122, 122' heat up each other. Each light emitting element 122, 122' has its own cooling element/cooling fin. Thereby an effective cooling of each light emitting element 122, 122' is obtained while an overheating because of the reception of heat of a neighboring light emitting element 122, 122' is prevented to a large extent.

The upstanding heat isolating structures 209 may also extend, as seen at (c) in the cross-sectional view along Y-Y', up to the first side 204 and may be present in between the individual cooling fins. However, this is not necessary, and the heat isolating structures 209 may also be absent at the first side 104. In order to achieve that each light emitting element 122, 122' has its own cooling fin, the presence of the heat isolating structures 209 is also not necessary at the second side 206 of the heat isolating plate 202. The heat isolating structures 209 may be there to provide additional mechanical stability.

Figure 3:
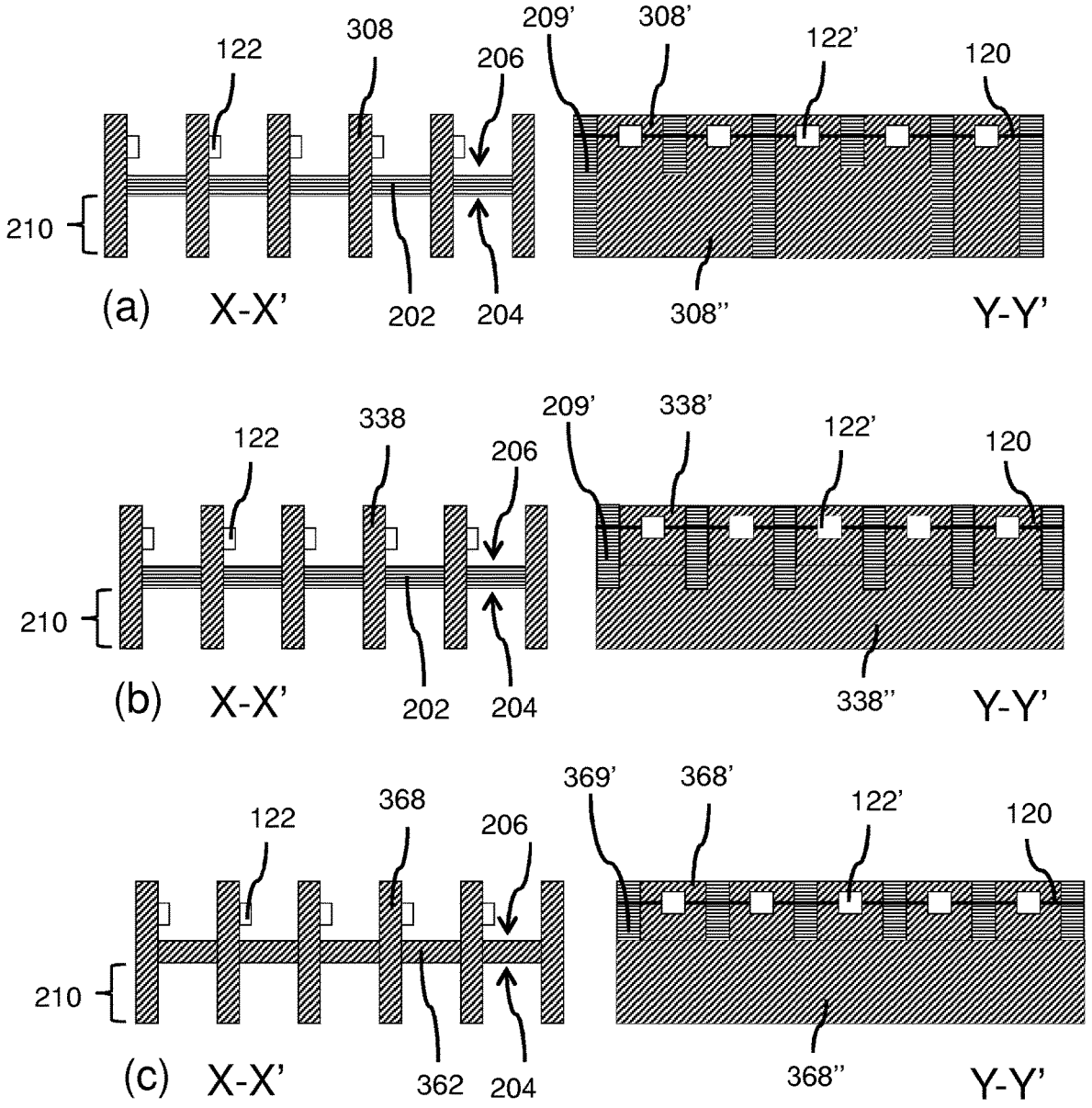

FIG. 3 schematically shows several cross-sectional views of alternative embodiments of one of the lighting assemblies of FIG. 1 or 2. As discussed in the context of FIG. 2, each light emitting element may be provided with an individual cooling fin. It may also be, as shown at the top at (a) and as can be seen in the Y-Y' cross sectional view of (a) at the right, that two light emitting elements 122, 122' may both have at the second side 206 an individual upstanding wall 308, 308' separated by an heat isolating structure 209, 209, while at the first side 204, these two upstanding walls 308, 308' may be thermally coupled to one cooling fin 308". Thereby only two light emitting elements 122, 122' may transfer heat to each other.

As shown at (b) and as can be seen in the Y-Y' cross sectional view of (b), at the first side 204 of the heat isolating plate 202, the upstanding walls 338, 338' may be coupled to one cooling fin 338" and thereby a group of upstanding walls 338, 338' may provide heat to each other via a heat conductive path via the cooling fin 338". In particular, in this example of (b), and when interpreted in the context of, for example, the lighting assembly of FIG. 2, each row of light emitting elements 122, 122' are thermally coupled to each other, but the individual rows are thermally isolated from each other thereby preventing that a row becomes too hot because of the heat generation in a neighboring row.

As shown at (c), the basis of the heat transferring element may be a heat conductive plate 362 from which heat conductive upstanding walls 368, 368' extend at the second side and each, or a group of light emitting elements 122, 122' is coupled to a single extending heat conductive upstanding wall 368, 368'. A heat isolating element 369' may be provided in between the heat conductive upstanding walls 368, 368'. In the example of (c), the heat conductive plate 362 has at its first side 204 cooling fins 368".

Figure 4:
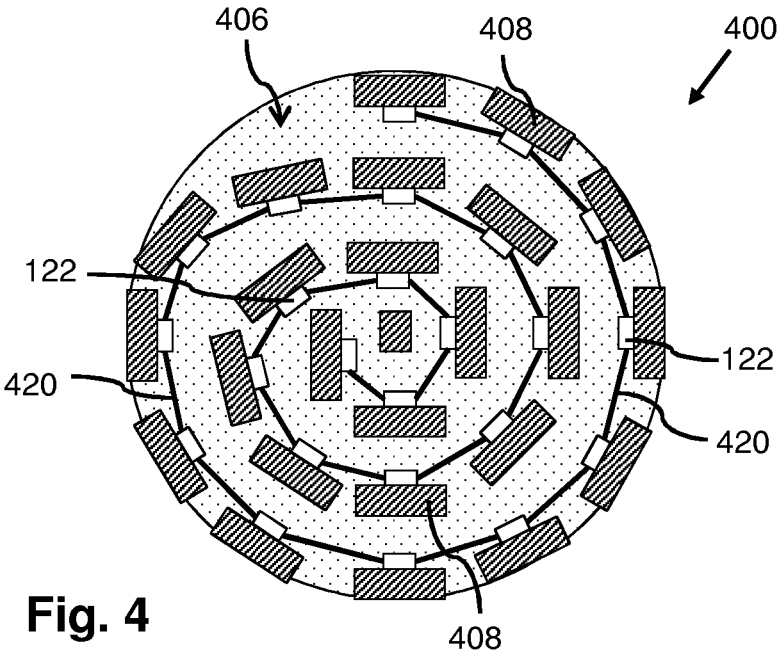

FIG. 4 schematically shows a further embodiment of a lighting assembly 400. Lighting assembly 400 is similar to previously discussed embodiments of the lighting assembly and has similar effects and advantages. Differences are discussed hereinafter. FIG. 4 presents a top view. The lighting assembly has a circular shape when seen in the top view. At a second side 406 of the heat transferring element individual upstanding walls 408 of a heat conductive material are provided. The upstanding walls 408 are thermally coupled to a first side (not shown—opposite to the second side 406) of the heat transferring element. In line with previously discussed embodiments, the upstanding walls 408 may extend out of the first side to form cooling fins or they may extend up to the first side such that a good thermal path is obtained to the heat sink interface or to the heat sink. The individual upstanding walls 408 are separated from each other by means of ambient air. The base plate of the heat transferring element (of which the second side 406 is shown) may be made of a heat conductive material or of a heat isolating material. The individual upstanding walls 408 are arranged around the center of the base plate and form an approximated spiral shape when seen in a plane perpendicular the second side 406. The lighting assembly 400 also comprises an elongated element that comprises power wires 420 that are arranged in between a sequence of light emitter elements 122. The power wires 420 are slightly flexible and allow the arrangement of the elongated element in the shape of a spiral (when seen in a cross-sectional view along a plane parallel to the second side 406) with at least two windings. At the locations where the elongated element has light emitting elements 122, the back sides of the light emitting elements 122 are thermally coupled to one of the upstanding walls 408. The back side of the light emitting element 122 is the side that is opposite the largest surface through which light is emitted. In line with the discussion of FIG. 2, the individual light emitting element 122 are well cooled by the lighting assembly 400 and about no cross-heating is obtained between the different light emitting elements 122.

Figure 5:
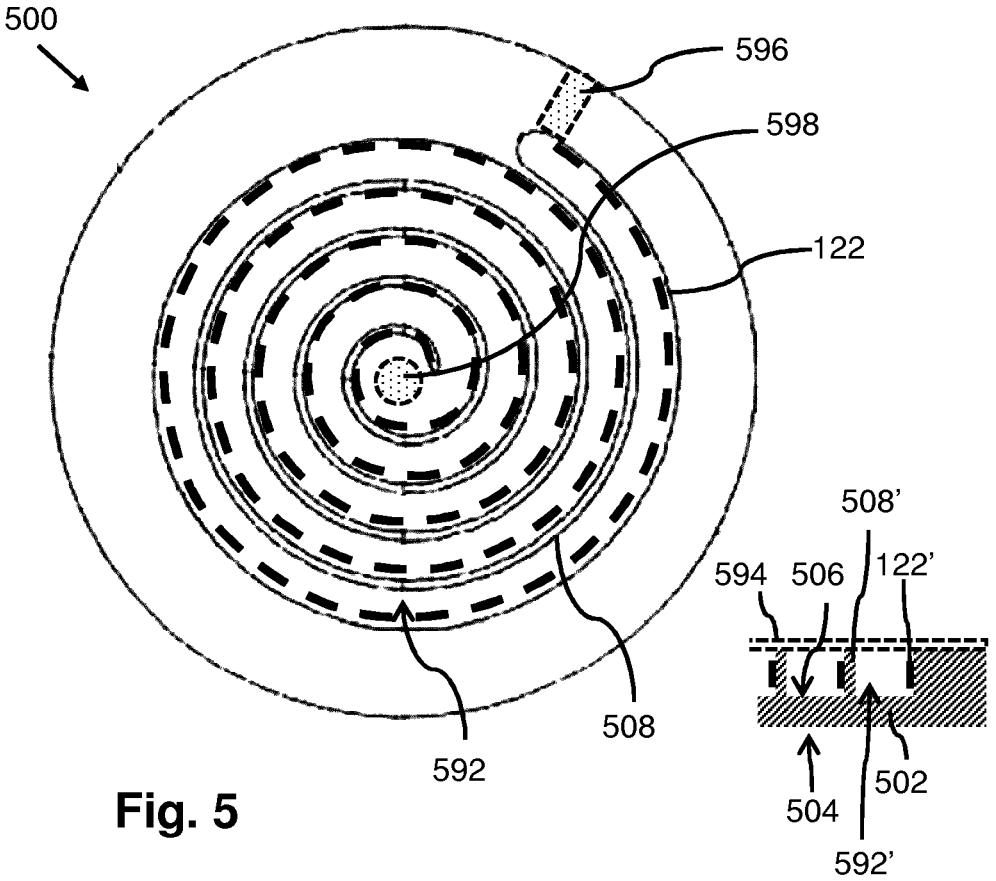

FIG. 5 schematically shows yet another embodiment of a lighting assembly 500. Lighting assembly 500 is similar to previously discussed embodiments of the lighting assembly and has similar effects and advantages. Differences are discussed hereinafter. At the left end a top view is presented and at the right bottom end of FIG. 5 a cross-sectional view of a portion of the lighting assembly 500 has been presented. Lighting assembly 500 is formed by a heat conductive plate 502 in which, according to a spiral pattern with 5 windings, a channel 592, 592' is formed. Between neighboring portions of the channel 592, 592', upstanding walls 508, 508' remain. Because the lighting assembly 500 is based on a heat conductive plate 502, the upstanding walls 508, 508' are thermally coupled towards a first side 504 of the heat conductive plate 502. In the context of this document, the bottom of the channels 592, 592' is the second side from which the upstanding walls 508, 508' extend. In FIG. 5 only the light emitting elements 122 122' of the elongated structure have been drawn. In line with previous embodiments, a LED strip, or an elongated structure with solid state light emitters coupled to each other by means of power wires, or any other appropriate elongated structure can be used.

Optionally, on top of the channels is provided a light transmitting plate 594 through which light can be emitted into the ambient. Thereby the channel 592, 592' forms a sort of channel through which a cooling material, such as air or any fluid can be transported to cool the light emitting elements 122, 122'. For this purpose, the lighting assembly 500 may comprise a cooling material inlet 596 and cooling material outlet 598. The locations where the inlet 596 and the outlet 598 are drawn are relatively good location because one is at the end of the spiral and one is at the beginning of the spiral, however, embodiments of the locations of the inlet 596 and the outlet 598 are not limited to the presented locations—it is relevant whether a cooling material can flow through a portion of the channel or channels and that at least a portion of the light emitting elements 122, 122' are cooled by the cooling material.

Figure 6:
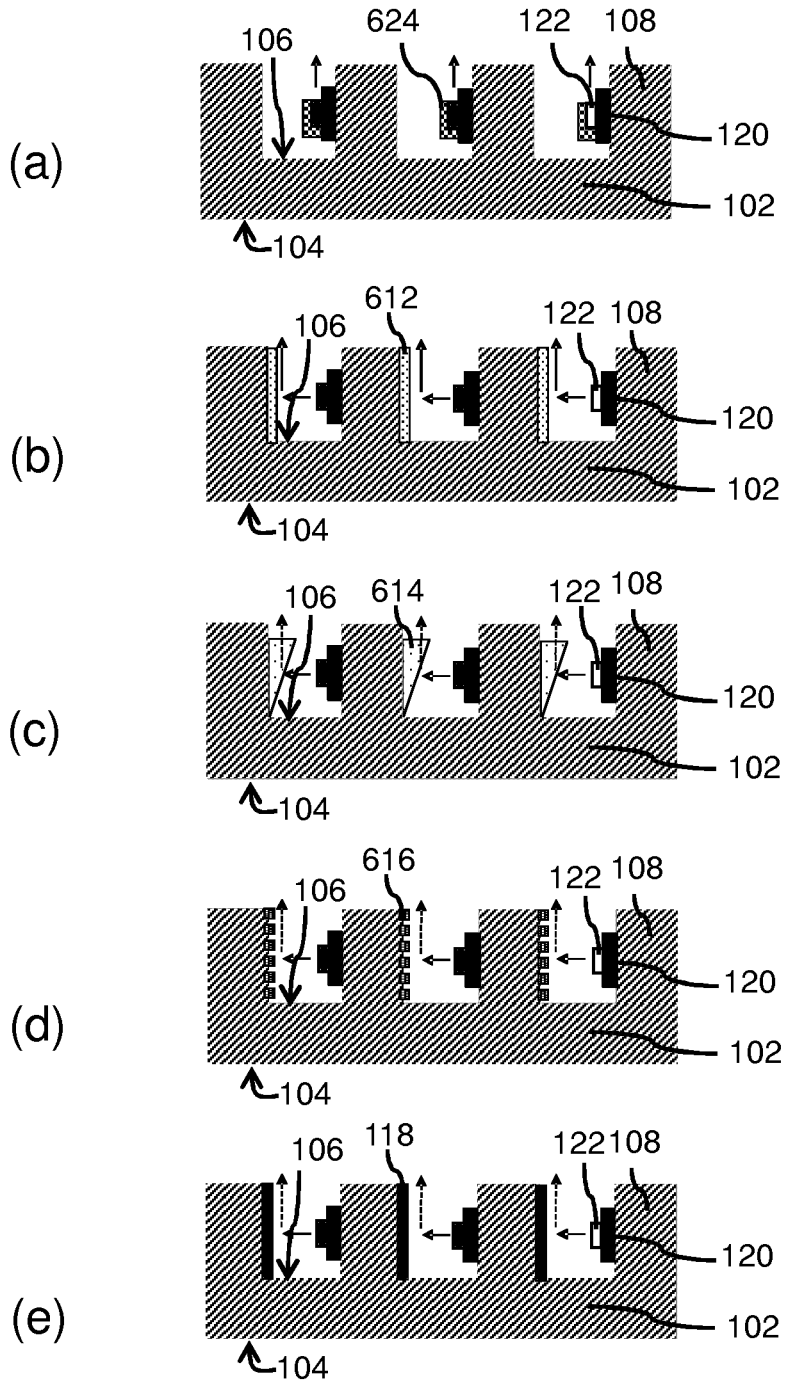

FIG. 6 schematically shows several cross-sectional views of previously discussed lighting assemblies in which optical elements are introduced to improve light output from the lighting assembly. In all cross-sectional views the upstanding walls 108 can be seen that extend from the second side 106 of a base plate of the heat transferring element 102. In line with previous embodiments, the base plate may be made of a heat conductive or heat isolating material. In line with previous embodiments, the upstanding walls 108 may also extend through the base plate towards the first side 104 and optionally form also cooling fins at the first side 104.

As can be seen at FIG. 6 at (b) and as also could be seen in previously presented cross-sectional views, the light emitting elements 122 will most probably emit light into the channel(s) formed in between the upstanding walls 108. Additional optical elements, light outcoupling elements or reflective material may be provided at locations in the channel(s) where light impinges on surfaces of the channel(s). In, for example, (b) it is shown that a (white) reflective material 612 is provided opposite to the light emitting element 122. The (white) reflective material may be diffusely reflective. It is to be noted that also the whole surface of the channel(s) may be provided with this (white) reflective material 612 such that a relatively homogeneous light output is obtained.

In contrast to the presented solution of (b), as shown at (a), one may also provide specific light reflective layers 624 on top of the light emitting elements 122 such that the light is directly transmitted from a surface of the light emitting element 122 that faces towards a light output window of the lighting assembly. Then, the amount of light that is emitted into the channel is limited. In another embodiment, side emitting light emitting elements are used which are light emitting elements that emit most of their light at least through one of their side surfaces. The side light emitting elements have to be arranged in the lighting assembly such that these side surfaces face the ambient, which means, face towards the light exit window of the lighting assembly.

Alternatively to the solution of (b), as shown at (c), one may also provide an optical light guiding elements 614, such as a transparent wedge shaped element into the channel such that light is guided by transparent wedge shaped elements towards a light output window of the lighting assembly (which is in the context of FIG. 6 an entrance of the channel(s)).

Alternatively to the solution of (b), as shown at (d), surfaces of the channel(s) may be provided with light diffusing elements. Light that impinges on the light diffusing element is diffracted in a multitude of directions and as such also partly toward the light output window of the lighting assembly. This is in particular advantageous if the surface of the channels is also reflective such that light that is diffracted further into the channel is still reflected towards the light output window of the lighting assembly.

Alternatively to the solution of (b), or even in combination with the solution of (b), a surface of the channel that is opposite to a light emitting element 122 may also be provided with a luminescent element 618 that comprise luminescent material that partly converts light received from the light emitting elements 122 towards light of another color. Often the luminescent material diffuses the impinging light and light of the another color such that at least a significant portion of the combined light is transmitted towards the light output window of the lighting assembly.

Figure 7:
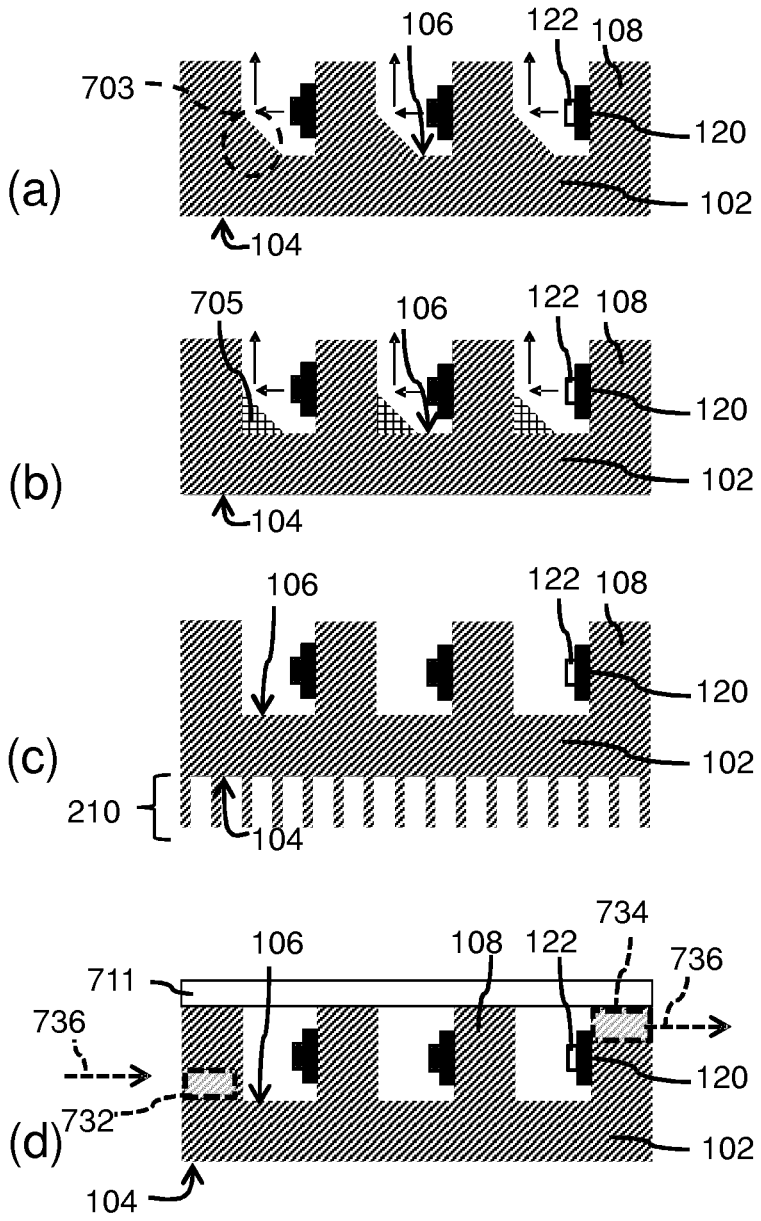

FIG. 7 schematically shows several cross-sectional views of alternative embodiments of previously discussed lighting assemblies. The embodiments shown at (a) has in a channel, at least at location where light emitted by the light emitting elements 122 impinges, instead of a sharp angle corner a truncated corner such that the truncated corner 703 may act as a mirror (or a diffusely reflective mirror) for reflecting light towards the light output window of the lighting assembly. An assumption is that the surfaces of the channel(s) at least reflect some light. In all the discussed embodiments, the surface of the channel(s) may be specularly reflective or diffusely reflective. In all the discussed embodiments, the surfaces of the channel(s) may reflect at least 50% of the light that impinges on the surfaces, or optionally at least 75% of the light that impinges on the surfaces, or, optionally at least 90% of the light that impinges on the surfaces.

Alternatively to the solution of (a), as shown at (b), the corners of the channel(s) opposite to the light emitting element 122 can also be filled/truncated by an additional light reflective material 705 or an additional luminescent material (in line with the discussion of FIG. 6 (*e*)).

At (c) it has been shown that at the first side 104 cooling fins may be provided that form a heat sink 210. In previous embodiments the heat sink is formed by the upstanding walls that completely extend through the heat transferring element 102 and also extend from the first side. In the example of (c), the upstanding walls do not extend complete through the heat transferring element 102, but separate walls/fins are provided at the first side 104.

At (d) it has been shown that the channel(s) may be closed by means of a light transmitting panel 711. Also, as an example, a cooling material inlet 732 and a cooling material outlet 734 may be provided for providing and receiving a cooling material 736 to or from the channel(s).

Figure 8:
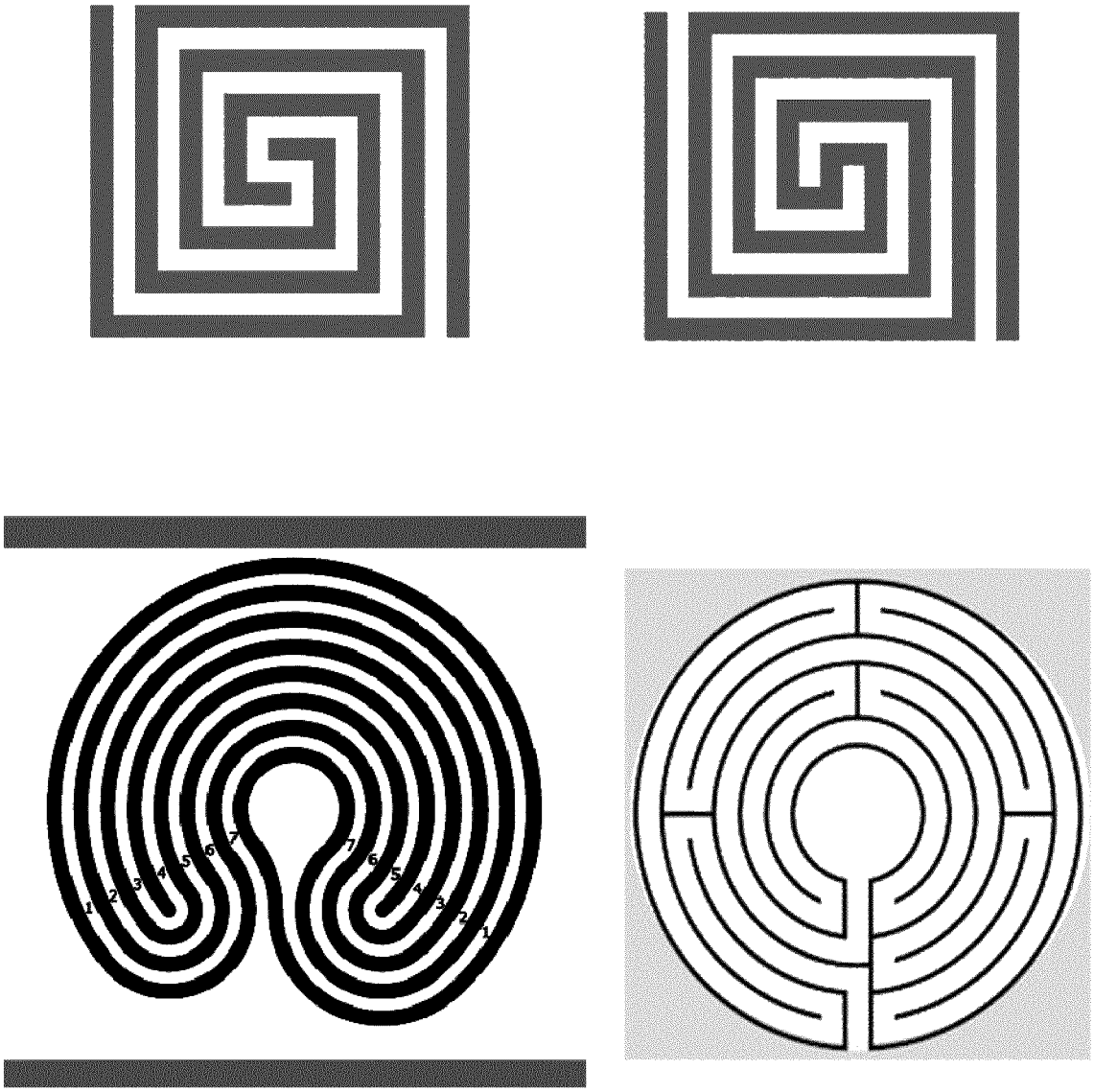

FIG. 8 schematically presents embodiments of meandering or spiral patterns that can be followed by the elongated structure and/or the upstanding wall(s).

Figure 9:
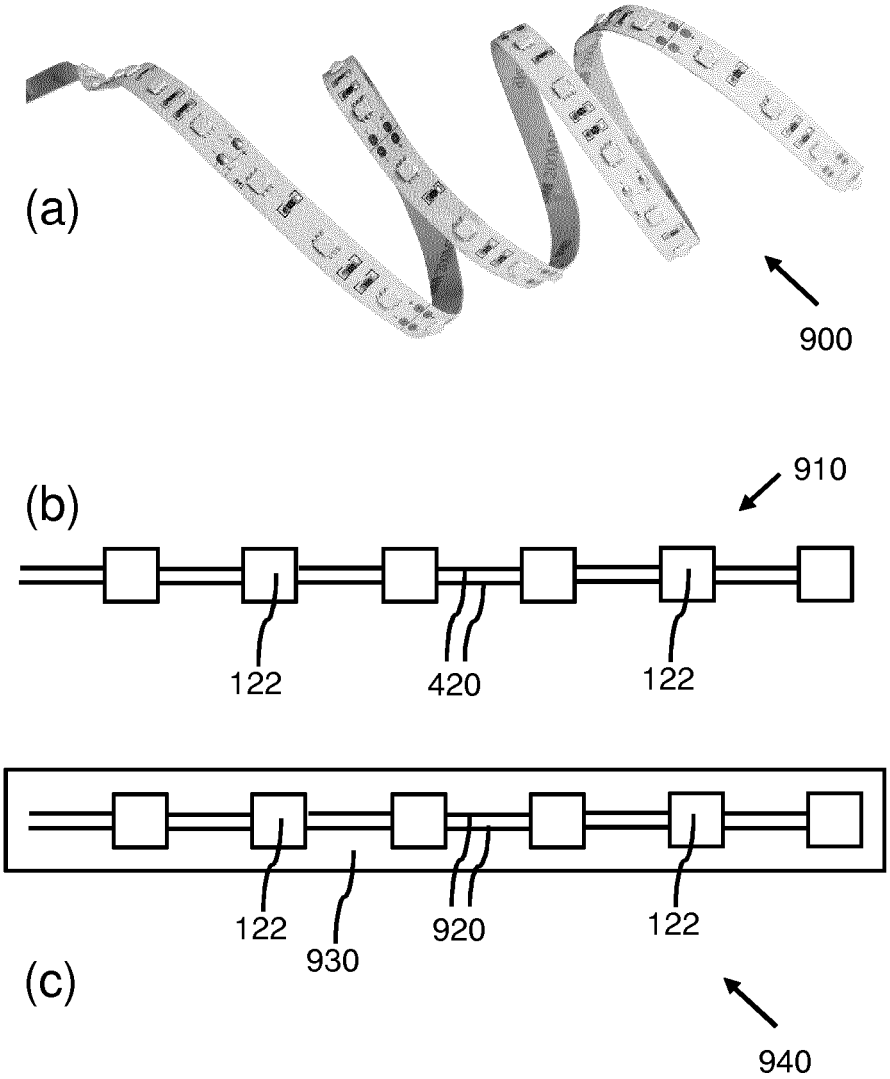

FIG. 9 schematically presents embodiments of an elongated structure. At (a) a LED strip 900 is presented as an example of such an elongated structure. The LED strip is based on a flexible substrate on which electrically conductive tracks are provided and on which Light Emitting Diodes (LEDs) are provided. At (b) an elongated structure 910 is shown that has been discussed in the context of FIG. 4. The elongated structure 910 comprises light emitting elements 122 (for example, solid state light emitters) and comprises power wires 420 in between the light emitting elements 122. The power wires 420 may be flexible enough to bend the elongated structure into a spiral or meandering shape. At (c) a strip like element 940 is drawn that is based on a substrate 930 that is at least flexible enough to form a spiral or meandering shape. On the substrate 930 are provided power wires or electrically conductive tracks 920 that provide power to the light emitting elements. As can be seen at (a), (b) and (c), the light emitting elements are arranged in a sequential order. Note however that a sequential order does not mean that the light emitting elements are arranged in a strict series or parallel arrangement. Also note that in the example of (b) and (c) only two electrical connections are drawn between the light emitting elements 122—embodiments are not limited to this number, also three or more electrical connections may be provided such that the light emitting elements 122 can be arranged in any combination of an electrical series arrangement or electrical parallel arrangement.

Figure 10:
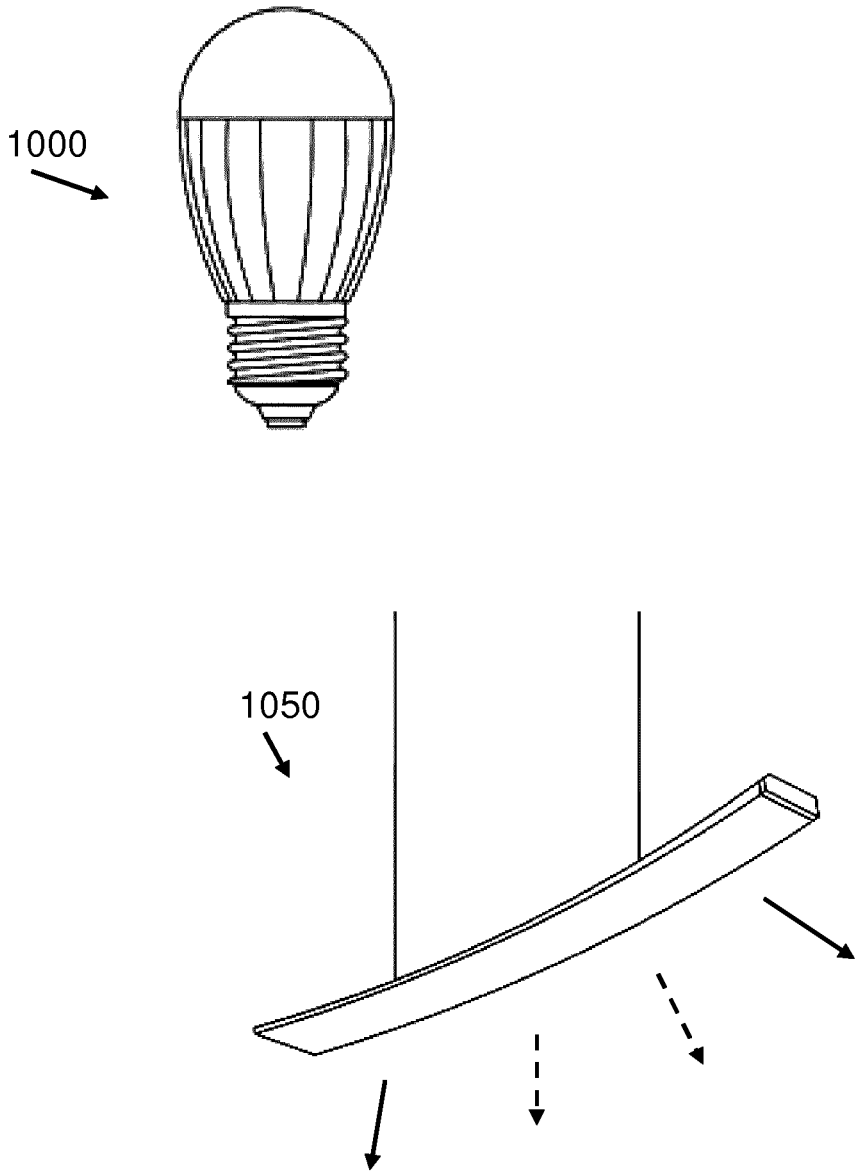

FIG. 10 schematically presents embodiments of a lamp 1000 and of a luminaire 1050. Both the lamp 1000 and luminaire 1050 may comprise one of the embodiments of the above discussed lighting assemblies such that a high lumen output can be provided by the lamp 1000 and the luminaire 1050. The lighting assembly is compact and, thus, can be used in the lamp 1000 and the luminaire 1050.

In summary, alighting assembly, a light source, a lamp and a luminaire are provided. The lighting assembly comprises a heat transferring element and an elongated structure comprising light emitting elements and power connections. The heat transferring element comprises at a first side a heat sink interface or a heat sink element. At the second opposite side one or more upstanding walls are provided extending away from the second side. The upstanding walls are heat conductive and thermally coupled to the first side. The elongated structure is arranged on a wall surface of at least one of the upstanding walls. The wall surface is adjacent to the second side. A surface of the elongated structure through which no light is emitted is thermally coupled to the wall surface. A pattern formed by the elongated structure is a meandering or spiral pattern.

Further embodiments are provided in the subsequent clauses:

1. A lighting assembly (100, 200, 400, 500) for emitting light, the lighting assembly (100, 200, 400, 500) comprising:

an elongated structure (120, 900, 910, 940) comprising light emitting elements (122, 122') and power connections (420, 920) for providing power to the light emitting elements (122, 122'), the light emitting elements (122, 122') being arranged in a longitudinal direction of the elongated structure (120, 900, 910, 940), a heat transferring element (102) comprising at a first side (104, 204, 504) a heat sink interface or a heat sink element (210) and comprising at a second side (106, 206, 406, 506) one or more upstanding walls (108, 208, 338, 368, 408, 508) extending away from the second side (106, 206, 406, 506), the second side (106, 206, 406, 506) is opposite to the first side (104, 204, 504), the one or more upstanding walls (108, 208, 338, 368, 408, 508) comprising a heat conductive material and being thermally coupled to the first side (104, 204, 504), wherein the elongated structure (120, 900, 910, 940) is arranged on a wall surface (107, 107') of at least one of the one or more upstanding walls, the wall surface (107, 107') is one of the surfaces of the one or more upstanding walls (108, 208, 338, 368, 408, 508) that is adjacent to the second side (106, 206, 406, 506), a surface of the elongated structure (120, 900, 910, 940) through which no light is emitted by the light emitting elements (122, 122') is thermally coupled to the wall surface (107, 107'), a pattern formed by the elongated structure (120, 900, 910, 940) is a meandering or spiral pattern, the pattern is defined in a cross-sectional plane parallel to the second side (106, 206, 406, 506).

2. A lighting assembly (100, 200, 400, 500) according to clause 1, wherein spaces between at least a portion of the one or more upstanding walls (108, 208, 338, 368, 408, 508) form channels (592, 592'), the light emitting elements (122, 122') are arranged to emit at least a portion of their light into the channels (592, 592').

3. A lighting assembly according to clause 2, wherein reflective material (612, 705) is provided or light outcoupling elements (614, 616, 118) are provided in the channels at at least a portion of locations of the one or more channels (592, 592') that are illuminated by the light emitting elements (122, 122').

4. A lighting assembly (100, 200, 400, 500) according to any one of the preceding clauses, wherein the light emitting elements (122, 122') are arranged to emit light into a direction parallel to the second side (106, 206, 406, 506).

5. A lighting assembly (100, 200, 400, 500) according to any one of the preceding clause, wherein spaces between at least a portion of the one or more upstanding walls (108, 208, 338, 368, 408, 508) form one or more channels (592, 592') that are covered at an opposite side of the second side with a light transmitting material (594, 711) for sealing the opposite side of the one or more channels (592, 592'), and the one or more channels (592, 592') are provided with a cooling material inlet (596, 732) and a cooling material outlet (598, 734) for allowing a cooling material (736) to flow through the one or more channels for cooling the light emitting elements (122, 122') of the elongated structure (120, 900, 910, 940).

6. A lighting assembly (100, 200, 400, 500) according to anyone of the preceding clauses, wherein a wall pattern formed by a portion of the one or more upstanding walls (108, 208, 338, 368, 408, 508) is a meandering or spiral pattern, the wall pattern is defined in a cross-sectional plane parallel to the second side (106, 206, 406, 506).

7. A lighting assembly (100, 200, 400, 500) according to anyone of the preceding clauses, wherein a first portion of the one or more upstanding walls (108, 208, 338, 368, 408, 508) is thermally isolated from a second portion of the one or more upstanding walls (108, 208, 338, 368, 408, 508) while the one or more upstanding walls (108, 208, 338, 368, 408, 508) of the first portion and of the second portion are thermally coupled to the first side (104, 204, 504).

8. A lighting assembly (100, 200, 400, 500) according to any one of the preceding clauses, wherein the heat transferring element (102) comprises cooling fins (210) at the first side (104, 204, 504).

9. A lighting assembly (100, 200, 400, 500) according to any one of the preceding clauses, wherein the elongated structure (120, 900, 910, 940) is a LED strip (900) made of a flexible substrate on which solid state light emitters are provided and on which electrical conductive tracks are provided that form the power connections.

10. A lighting assembly (100, 200, 400, 500) according to any one of the clause 1 to 8, wherein the elongated structure (120, 900, 910, 940) is formed by a sequence of solid state light emitters that are coupled to each other by wires (420, 920) forming the power connections.

11. A lighting assembly (100, 200, 400, 500) according to any one of the preceding clauses, wherein the light emitting elements (122, 122') are solid state light emitters.

12. A lighting assembly (100, 200, 400, 500) according to any one of the preceding clauses, wherein an angle between the wall surface (107, 107') and the second side (106, 206, 406, 506) is in between 85 and 95 degrees, is optionally in between 88 and 92 degrees and is optionally substantially equal to 90 degrees.

13. A light source composing the lighting assembly (100, 200, 400, 500) according to any one of the preceding clauses.

14. A lamp (1000) comprising the lighting assembly (100, 200, 400, 500) according one of the clauses 1 to 12 or comprising the light source according to clause 13.

15. A luminaire (1050) comprising the lighting assembly (100, 200, 400, 500) according one of the clauses 1 to 12, comprising the light source according to clause 13, or comprising the lamp (1000) according to clause 14.

It will be appreciated that the above description for clarity has described embodiments of the invention with reference to different functional units. However, it will be apparent that any suitable distribution of functionality between different functional units may be used without deviating from the invention. For example, functionality illustrated to be performed by separate units, may be performed by one unit or may be provided by several units. Hence, references to specific functional units are only to be seen as references to suitable means for providing the described functionality rather than indicative of a strict logical or physical structure or organization. The invention can be implemented in any suitable form including hardware, software, firmware or any combination of these.

It is noted, that in this document the word 'comprising' does not exclude the presence of other elements or steps than those listed and the word 'a' or 'an' preceding an element does not exclude the presence of a plurality of such elements, that any reference signs do not limit the scope of the claims. Further, the invention is not limited to the embodiments, and the invention lies in each and every novel feature or combination of features described above or recited in mutually different dependent claims.

The invention claimed is:

1. A lighting assembly for emitting light, the lighting assembly comprising:

an elongated structure comprising a flexible substrate and comprising light emitting elements and power connections for providing power to the light emitting elements on the flexible substrate, the light emitting elements being arranged in a longitudinal direction of the elongated structure, a heat transferring element comprising a base plate comprising a first side and an opposite second side, the heat transferring element comprising at the first side a heat sink interface or a heat sink element and comprising at the second side one or more upstanding walls extending away from the second side, the second side is opposite to the first side, the one or more upstanding walls comprising a heat conductive material and being thermally coupled to the first side, wherein the elongated structure is arranged on a wall surface of at least one of the one or more upstanding walls, the wall surface is one of the surfaces of the one or more upstanding walls that is adjacent to the second side, a surface of the elongated structure through which no light is emitted by the light emitting elements is thermally coupled to the wall surface, a pattern formed by the elongated structure is a meandering or spiral pattern, the pattern is defined in a cross-sectional plane parallel to the second side, the meandering pattern comprises at least three turns and the spiral pattern comprises a plurality of windings, wherein spaces between at least a portion of the one or more upstanding walls form channels, the light emitting elements are arranged to emit at least a portion of their light into the channels; and wherein at least 75% of the light emitting elements emit a portion of their light towards a second surface of an opposite wall of the channel, wherein the opposite wall of the channel is a portion of the one or more upstanding wall, the opposite wall having two surfaces adjacent to second side of which one is the wall surface and another one is the second surface.

2. A lighting assembly according to claim 1, wherein reflective material is provided or light outcoupling elements are provided in the channels at least a portion of locations of the one or more channels that are illuminated by the light emitting elements.

3. A lighting assembly according to claim 1, wherein the light emitting elements emit a light emission and the light emitting elements are arranged such that a central axis of the light emission is substantially parallel to the second side.

4. A lighting assembly according to claim 1, wherein spaces between at least a portion of the one or more upstanding walls form one or more channels that are covered at an opposite side of the second side with a light transmitting material for sealing the opposite side of the one or more channels, and the one or more channels are provided with a cooling material inlet and a cooling material outlet for allowing a cooling material to flow through the one or more channels for cooling the light emitting elements of the elongated structure.

5. A lighting assembly according to claim 1, wherein a wall pattern formed by a portion of the one or more upstanding walls is a meandering or spiral pattern, the wall pattern is defined in a cross-sectional plane parallel to the second side.

6. A lighting assembly according to claim 1, wherein a first portion of the one or more upstanding walls is thermally isolated from a second portion of the one or more upstanding walls while the one or more upstanding walls of the first portion and of the second portion are thermally coupled to the first side.

7. A lighting assembly according to claim 1, wherein the heat transferring element comprises cooling fins at the first side.

8. A lighting assembly according to claim 1, wherein the elongated structure is a LED strip.

9. A lighting assembly according to claim 1, wherein the light emitting elements are solid state light emitters.

10. A lighting assembly according to claim 1, wherein an angle between the wall surface and the second side is in between 85 and 95 degrees, is optionally in between 88 and 92 degrees and is optionally substantially equal to 90 degrees.

11. A light source composing the lighting assembly according to claim 1.

12. A lamp comprising the lighting assembly according to claim 10.

13. A luminaire comprising the lighting assembly according to claim 10.

* * * * *